United States Patent [19]

Hübel

[11] Patent Number: 5,024,732

[45] Date of Patent: Jun. 18, 1991

[54] METHOD OF AND DEVICE FOR COMPENSATING VARIATIONS OF BRANCH CURRENTS IN ELECTROPLATING BATHS

[75] Inventor: Egon Hübel, Feucht, Fed. Rep. of Germany

[73] Assignee: Schering Aktiengesellschaft, Berlin and Bergkamen, Fed. Rep. of Germany

[21] Appl. No.: 241,595

[22] Filed: Sep. 7, 1988

[30] Foreign Application Priority Data

Sep. 24, 1987 [DE] Fed. Rep. of Germany ..... 3732476

[51] Int. Cl.[5] ..... C25D 21/12; C25D 5/18

[52] U.S. Cl. ..... 204/1.11; 204/228

[58] Field of Search ..... 204/228, 297 R, 1.11

[56] References Cited

U.S. PATENT DOCUMENTS

| | | | |
|---|---|---|---|
| 3,470,082 | 9/1969 | Raymond et al. | 204/228 |
| 3,592,754 | 7/1971 | Aihara | 204/228 X |
| 4,461,690 | 7/1984 | Rolff et al. | 204/228 |
| 4,490,230 | 12/1984 | Fletcher | 204/228 |
| 4,786,384 | 12/1988 | Gerhardt et al. | 204/228 X |

*Primary Examiner*—Donald R. Valentine

*Attorney, Agent, or Firm*—Michael J. Striker

[57] ABSTRACT

A method for compensating variations of branch currents in an electrolytic bath and hence for improving the uniformity of metal layers deposited on articles, provides a compensating passive resistor having a resistance value exceeding the resistance of respective electroplating branch circuits, in series with each branch circuit. The total electroplating current is adjusted to the nominal branch currents whereby the magnitudes of the latter is determined predominantly by the compensating passive resistors.

10 Claims, 1 Drawing Sheet

METHOD OF AND DEVICE FOR COMPENSATING VARIATIONS OF BRANCH CURRENTS IN ELECTROPLATING BATHS

BACKGROUND OF THE INVENTION

The present invention relates in general to electroplating and in particular to a method of compensating operational variations of nominal branch currents in an electroplating bath in order to improve the uniformity of the thickness of layers deposited on the treated articles.

In general a circuit for electroplating a plurality of articles includes an electrolytic bath in which a plurality of articles together with corresponding anode plates are immersed, a source of total current connected via branch conductors to the anodes and to the articles acting as cathodes.

It is desirable to maintain branch currents in all branch circuits substantially at the same magnitude in order to obtain a substantially uniform thickness of galvanically deposited layers on all articles connected as cathodes.

In practice, a multitude of interferences contribute to irregular distribution of branch currents between respective anodes and cathodes. For example the interferences result from differences in contacts of respective anodes and cathodes to the corresponding conductors, from different spacing between respective anodes and cathodes, from differences in activity of anodes or cathodes and from diffferent resistances of the anode and cathodes.

From German DE-OS 29 51 708, a method is known which in order to improve the branch current distribution, employs regulating transistors in each branch circuit of the electroplating bath in order to actively regulate the individual branch currents which are measured by means of measuring resistors. This known circuit has the advantage that within the adjustment of respective regulators a complete compensation or equalization of all branch currents is made possible; the disadvantage of this known circuit is a relatively high cost of the regulating devices and circuitry.

SUMMARY OF THE INVENTION

It is therefore a general object of the present invention to overcome the aforementioned disadvantage.

More particularly, it is an object of this invention to provide a method of and a device for compensating variations of branch currents in an electroplating bath which achieves an improvement in the distribution of the thickness of the deposited layers with a minimum cost for regulating devices.

In keeping with this object and others which will become apparent hereafter, one feature of the method of this invention resides in connecting in series with each branch electroplating circuit a passive resistor whose value exceeds the variation range of the resistance of individual branch circuits and the total current applied to the electroplating bath is adjusted to nominal operational currents for the branch circuit. Preferably, all the series connected passive resistors have the same value. If necessary, the value of the passive resistance can be adjusted to different nominal resistances of the corresponding branch circuit. In the preferred embodiment, all the passive resistors are arranged either on an anode bus bar or on a cathode bus bar. In a modification, the passive resistors can be arranged on anode holders or anode receptacles or in supports for articles to be electroplated.

The method of this invention makes it possible to achieve with a minimum construction cost a substantial improvement in the compensation of variations of the nominal branch currents in the electroplating bath and consequently a considerable improvement in the uniformity of the thickness of the deposited layers on the distributed articles.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
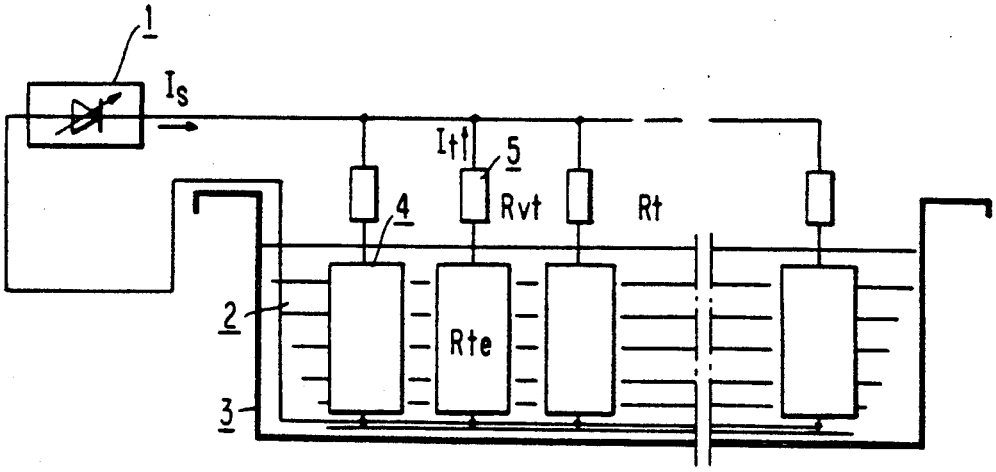
FIG. 1 is a substitute diagram of a circuit for electroplating a plurality of articles in an electroplating bath according to this invention.

Referring firstly to FIG. 1, an adjustable source delivers a total or source current Is to a plurality of parallel-connected branch circuits 4 represented by branch resistors Rt. In an actual electroplating circuit, branch circuit 4 is constituted by an article to be electroplated and an anode plate immersed into electroplating bath 2 in a tub 3. The article to be plated is connected via a conductor to a cathode bus bar connected to the negative electrode of the source whereas each anode plate is connected via a conductor to the anode bus bar connected to the positive electrode of the source.

Branch or partial currents It flowing through respective branch circuits 4 are determined according to Kirchhoff laws and are inversely proportional to the magnitude of the branch resistances Rt. The value of each branch resistance Rt corresponds to the sum of a compensating resistor Rvt whose function will be explained later, and of an operationally dependent electrolyte resistance Rte which includes resistance Rta of the anode plate plus the resistance Rtb of the corresponding part of the electroplating bath plus the resistance Rtk of the cathode or the treated article.

If the compensating resistor Rvt is selected to be large in comparison to the operation dependent variation range of the electrolyte resistance Rte, then the nominal branch current It is determined predominantly by this compensating resistor Rvt. By suitably adjusting the total current Is a sum of the nominal magnitude of the partial or branch current It flowing through the respective electrolytic resistances Rte, the desired degree of compensation of the operation dependent variations of the nominal branch current It in each electrolyte resistance Rte is predominantly determined by the series connected passive resistor Rvt.

Figure 2:
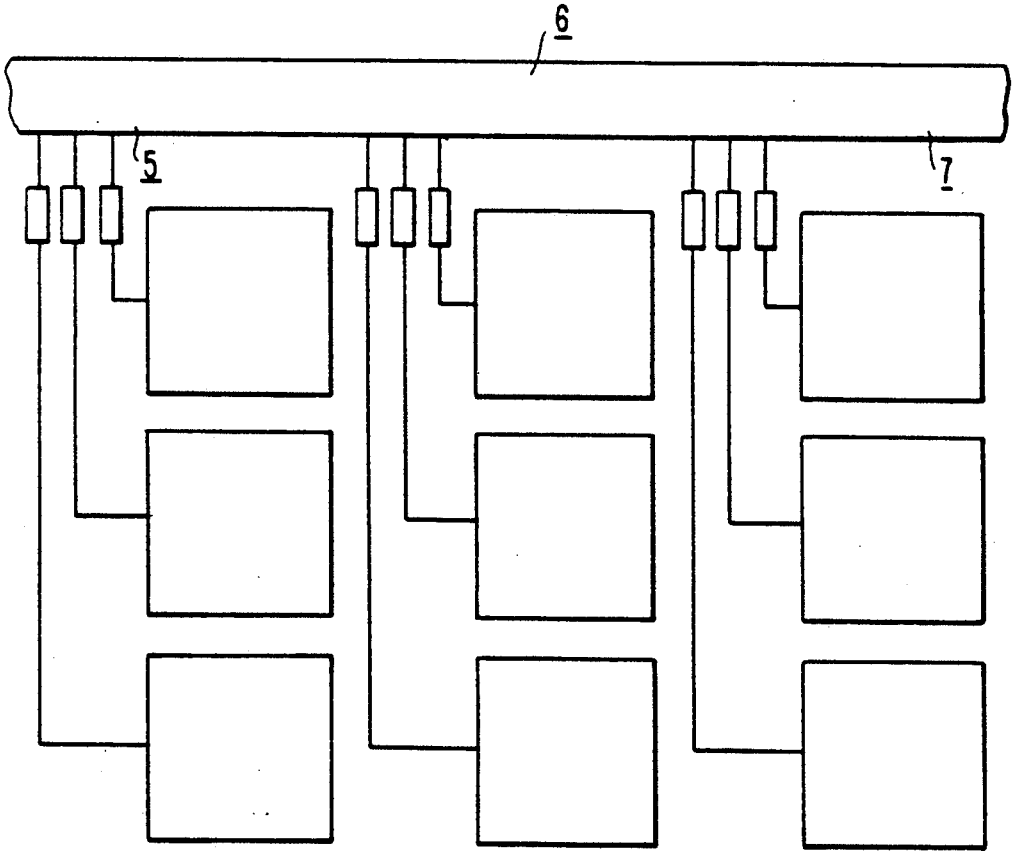
FIG. 2 is a side view of a portion of a cathode bus bar or article carrier provided with integrated passive resistors for respective branch circuits of this invention.

If the compensating passive resistors Rvt are connected in conductors leading to cathodes or articles, then it is of advantage to integrate the compensating resistors into the support or carrier part of the articles being treated. For example, as shown in FIG. 2, the cathode bus bar supporting the articles is combined with the compensating resistors Rvt for example by integrating therein inserts of corresponding resistive materials.

In a modification, the compensating series connected resistors Rvt can be distributed both in the vertical and in the horizontal direction that means the articles suspended on a cathode bus bar are connected in two dimensions, namely both horizontally and vertically via corresponding distributed compensating resistors Rvt. The provision of the compensating resistors directly on the article support has an additional advantage that only a single contact for the total galvanizing current is used. In the same manner, the compensating resistors can be integrated in the anode bus bar. The method and device of this invention can be used in connection with any conventional electroplating bath.

While the invention has been illustrated and described as embodied in specific examples of the electroplating circuit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of compensating operational variations of nominal branch currents in a circuit for electroplating a plurality of articles, the circuit including an electrolytic bath in which the articles and corresponding anode plates are immersed, a source of total electroplating current having its positive electrode connected to an anode bus bar for supporting the anode plates and its negative electrode connected to cathode bus bar for supporting the articles, the method comprising the steps of connecting in series with each electroplating branch circuit a passive compensating resistor $R_{vt}$ whose value exceeds the range of operation dependent electrolyte resistance $R_{te}$ of the corresponding branch circuit, and adjusting the total current $I_s$ from said source to the sum of nominal operation dependent branch currents $I_t$ of said branch circuits.

2. A method as defined in claim 1 wherein said compensating passive resistors have the same value.

3. A method as defined in claim 1 wherein said compensating passive resistance have different values.

4. A device for compensating operational variations of nominal branch currents in a circuit for electroplating a plurality of articles, the circuit including an electrolytic bath in which the articles and corresponding anode plates are immersed, a source of total current having its positive electrode connected to an anode bus bar and its negative electrode connected to cathode bus bar, comprising a plurality of compensating passive resistors connected parallel to each other to one of said bus bars and being series connected with respective branch circuits each constituted by an anode plate, a portion of the electroplating bath and an article connected as a cathode; the portion of the electroplating bath having an operation dependent range of resistance; and the value of each of said compensating passive resistors exceeding the resistance range of the corresponding electroplating bath portion.

5. A device as defined in claim 4 wherein said electroplating circuit includes a two dimensional array of articles to be electroplated and corresponding anode plates, and said compensating passive resistors being connected to the anodes or cathodes both in the horizontal and vertical direction.

6. A device as defined in claim 4 wherein said compensating passive resistors are integrated in said anode bus bar.

7. A device as defined in claim 4 wherein said compensating passive resistors are integrated in said cathode bar.

8. A device for compensating operational variations of nominal branch currents in a circuit for electroplating a plurality of articles, the circuit including an electrolytic bath in which the articles and corresponding anode plates are immersed, a source of total current having its positive electrode connected to an anode bus bar and its negative electrode connected to cathode bus bar, and a plurality of compensating passive resistors connected parallel to each other to one of said bus bars and being series connected with respective branch circuits each constituted by an anode plate, a portion of the electroplating bath and an article connected as a cathode, the value of each of said compensating passive resistors exceeding the resistance value of the corresponding branch circuit, and wherein said compensating passive resistors are integrated in anode holders.

9. A device for compensating operational variations of nominal branch currents in a circuit for electroplating a plurality of articles, the circuit including an electrolytic bath in which the articles and corresponding anode plates are immersed, a source of total current having its positive electrode connected to an anode bus bar and its negative electrode connected to cathode bus bar, and a plurality of compensating passive resistors connected parallel to each other to one of said bus bars and being series connected with respective branch circuits each constituted by an anode plate, a portion of the electroplating bath and an article connected as a cathode, the value of each of said compensating passive resistors exceeding the resistance value of the corresponding branch circuit, and wherein said compensating passive resistors are integrated in anode receptacles.

10. A device for compensating operational variations of nominal branch currents in a circuit for electroplating a plurality of articles, the circuit including an electrolytic bath in which the articles and corresponding anode plates are immersed, a source of total current having its positive electrode connected to an anode bus bar and its negative electrode connected to cathode bus bar, and a plurality of compensating passive resistors connected parallel to each other to one of said bus bars and being series connected with respective branch circuits each constituted by an anode plate, a portion of the electroplating bath and an article connected as a cathode, the value of each of said compensating passive resistors exceeding the resistance value of the corresponding branch circuit, and wherein said compensating passive resistors are integrated in supports for the articles being galvanized.

* * * * *